US010269243B1

(12) United States Patent
Tannenbaum

(10) Patent No.: US 10,269,243 B1
(45) Date of Patent: Apr. 23, 2019

(54) SYSTEM AND METHOD OF USE FOR SAFETY OF DRIVERS AND PEDESTRIANS IN TRAFFIC CIRCLES

(71) Applicant: Adam Benjamin Tannenbaum, Ashdod (IL)

(72) Inventor: Adam Benjamin Tannenbaum, Ashdod (IL)

( * ) Notice: Subject to any disclaimer, the term of this patent is extended or adjusted under 35 U.S.C. 154(b) by 0 days.

(21) Appl. No.: 16/030,828

(22) Filed: Jul. 9, 2018

(51) Int. Cl.

| | |
|---|---|
| ***G08G 1/00*** | (2006.01) |
| ***G08G 1/0962*** | (2006.01) |
| ***G08G 1/16*** | (2006.01) |
| ***G08G 1/005*** | (2006.01) |
| ***G08G 1/01*** | (2006.01) |

(52) U.S. Cl.
CPC ..... *G08G 1/09623* (2013.01); *G08G 1/005* (2013.01); *G08G 1/0116* (2013.01); *G08G 1/164* (2013.01); *G08G 1/166* (2013.01)

(58) Field of Classification Search
CPC ..... G08G 1/09623; G01C 21/00
USPC ..... 340/901, 907, 909, 910, 916, 917, 925, 340/944; 701/200, 211
See application file for complete search history.

(56) References Cited

U.S. PATENT DOCUMENTS

| | | | | |
|---|---|---|---|---|
| 5,982,278 | A | 11/1999 | Cuvelier | |
| 6,370,475 | B1 | 4/2002 | Breed et al. | |
| 6,487,500 | B2 | 11/2002 | Lemelson | |
| 7,057,532 | B2 | 6/2006 | Shafir et al. | |
| 7,106,219 | B2 | 9/2006 | Pearce | |
| 8,131,018 | B2 | 3/2012 | Wilson | |
| 8,280,621 | B2 | 10/2012 | Edwards et al. | |
| 8,965,685 | B1 | 2/2015 | Denaro | |
| 9,086,294 | B2 | 7/2015 | Geelen et al. | |
| 9,925,980 | B2 * | 3/2018 | Edo-Ros | B60W 30/0956 |
| 10,089,862 | B2 * | 10/2018 | Singh | G08G 1/005 |
| 2007/0100544 | A1 * | 5/2007 | Sugiura | G01C 21/005 701/431 |
| 2018/0096605 | A1 * | 4/2018 | Bai | G08G 1/166 |

* cited by examiner

*Primary Examiner* — Toan N Pham
(74) *Attorney, Agent, or Firm* — Robert Brownstein

(57) ABSTRACT

The invention disclosed comprises a system and method for managing pedestrian and vehicle action while traversing a traffic-circle intersection so as to optimize pedestrian and driver safety.

9 Claims, 7 Drawing Sheets

SYSTEM AND METHOD OF USE FOR SAFETY OF DRIVERS AND PEDESTRIANS IN TRAFFIC CIRCLES

TECHNICAL FIELD

The present invention relates to making pedestrians and drivers safer when traversing traffic circles.

BACKGROUND OF THE INVENTION

Many municipalities are adopting traffic circles rather than traffic-signal management of vehicle/pedestrian intersections. In a conventional traffic-signal intersection, the flow of vehicular and pedestrian traffic is controlled by traffic signals. Typically the traffic flow in one direction, say, North/South (N/S) is stopped while the traffic signal indicates it is okay for vehicles and pedestrians to travel East/West (E/W). Later, E/W traffic is stopped and N/S traffic is allowed to proceed. There are typically no barriers in place to prevent accidents and the system relies on the correct operation of the traffic signal and the cooperation of pedestrians and drivers based on traffic regulation protocols.

Traffic circles create a blockage of pedestrian and vehicular traffic directly through the intersection. Instead, vehicular traffic flow is diverted into circular-travel lanes where all vehicles travel in the same circular direction (e.g. counter-clockwise as viewed from above). There are no traffic signals stopping vehicles or pedestrians moving N/S or E/W. Traffic-circle protocols, based on driver/pedestrian cooperation, serve to control traffic flow.

There is, however, some risk of accident and injury associated with traffic circles. For example, someone entering a traffic circle from an extreme-left lane in a north-bound direction and wishing to leave from the next exit (e.g. an east-bound lane) would have to change lanes quickly in order to do so. Other vehicles in lanes to that driver's right could prevent that lane change setting up a risk of sideways collision or for the first driver to miss his/her exit and have to proceed around the traffic circle while attempting to change lanes. Also, pedestrians are typically served by a cross-walk pattern perpendicular to vehicular traffic flow. However, since there are no stop light traffic signals, pedestrians crossing a cross-walk are at risk of being struck by a vehicle entering or exiting the traffic circle.

The invention is a system and method of use that provides added safety to both drivers and pedestrians who are traversing a traffic-circle intersection.

BRIEF SUMMARY OF THE INVENTION

The invention herewith disclosed makes use of sensors, vehicular navigation, and personal mobile-device navigation, inter-vehicular wireless communications, cellular radio, and data processing technology in order to anticipate potential driver and/or pedestrian safety risks based on real-time conditions and to respond by issuing driver and/or pedestrian directives that reduce the safety risk. The term "sensor" comprises any variety of well-known technologies including but not limited to motion detection, position determination, and the like. It could include digital cameras, radar, infrared, sonar and any technology where successive sampling could determine position, direction and speed.

The system would be located essentially in the center of the traffic circle where its sensors can detect and process position, motion and speed of pedestrians and vehicles approaching the traffic circle. Using wireless communications technology, the system could issue directive messages to drivers and/or pedestrians that reduce the risk to safety. For example, a pedestrian approaching a cross-walk could receive an alert telling him/her to stop and wait because of oncoming vehicles. Drivers entering a traffic circle in a lane less appropriate for upcoming navigation steps could be alerted to the need for a lane change before entering the traffic circle so as to reduce the risk of sideways collisions or missed exits.

The system could also make use of GPS information from approaching vehicles and/or pedestrians in addition to sensor information. In such cases, the combination of technologies may add greater accuracy to conditional determinations. Having both sensor and GPS navigation information also insures that the system has backup where a driver's or pedestrian's GPS navigation is either turned off or not available. In addition, through application program interfaces (APIs) with popular navigation systems, directive messages can be sent using the navigation system's voice and screen prompts.

The impending introduction of autonomous driving vehicles is prompting the development of standardized inter-vehicle communications systems whereby vehicles in proximity to one another share next-step navigation data so as to orchestrate their interactive responses. Such standards and inter-vehicle communications systems could be integrated into this invention system such that the system appears to other vehicles as a valid participant in inter-vehicle data sharing processes.

Similarly, the alerting of pedestrians can make use of the cellular SMS technology to alert and inform pedestrians in near real time. A pedestrian lacking a mobile device would still be sensed in terms of position, motion and speed. However, only the driver would receive a directive message. As such, maximum protection occurs where pedestrians and vehicles have GPS navigation and communications systems enabled. Where neither the vehicle nor the pedestrian have operational GPS and communications systems, the invention system can still make use of the sensor data and make use of a visual alert to caution pedestrians and drivers.

BRIEF DESCRIPTIONS OF THE DRAWINGS

DETAILED DESCRIPTION OF INVENTION

Traffic circles are becoming an increasingly popular way of managing vehicle and pedestrian flow through an intersection. Typically, there are no traffic signals used for a traffic circle. The entrance and exit of vehicles relies on the cooperation of drivers with accepted traffic-circle protocols. For example, a vehicle in a circular traffic-circle lane has right of way over a vehicle that has not yet entered the traffic circle. In most cases, there is no need to start and stop traffic flow using a traffic signal as the protocols and diversion into circular lanes, as well as the central obstruction, reduces the risk of collisions within the intersection.

There remain some risks, however. A pedestrian traversing a cross walk may fail to notice a vehicle approaching the cross walk, and/or the driver of the vehicle may fail to notice the pedestrian traversing the cross walk. In the case of vehicles, a vehicle in a left-most lane entering a traffic circle and which must leave the circle at the first exit may have to cross two lanes to the driver's right in order to do so. If those lanes are occupied, it increases the risk of sideways collisions. Also, this driver having moved one or more lanes to his right may be unaware of a pedestrian in the cross walk.

A system that can reasonably accurately detect vehicles and pedestrians approaching a traffic circle and cross walk, and which can quickly determine the risk of an accident, can alert pedestrians and drivers when risk is above some predetermined level, L. Similarly, where vehicles are equipped with GPS navigation systems and wireless communications systems, and where drivers have opted in to allow sharing of near-term navigation steps with close-by vehicles, a system can determine position, direction and speed of the vehicle as it approaches a traffic circle, and determine which exit the vehicle will be directed to use. With that information, the system can determine which lane the vehicle should be in as it approaches the traffic circle, and which lane changes to make, and when to make them, so as to avoid missing the appropriate exit.

By making use of approaching vehicle and pedestrian position and speed, an invention system can apply known algorithms to determine the probabilities of collisions and assign a measure to that probability, say, L. Using some predetermined limit of L, the system can conditionally proceed to take action to alert drivers and pedestrians, or to hold back. As such, this invention system can significantly reduce the risk of vehicle/pedestrian and vehicle/vehicle collisions increasing the safety of both pedestrians and drivers as they traverse a traffic-circle intersection.

Figure 1:
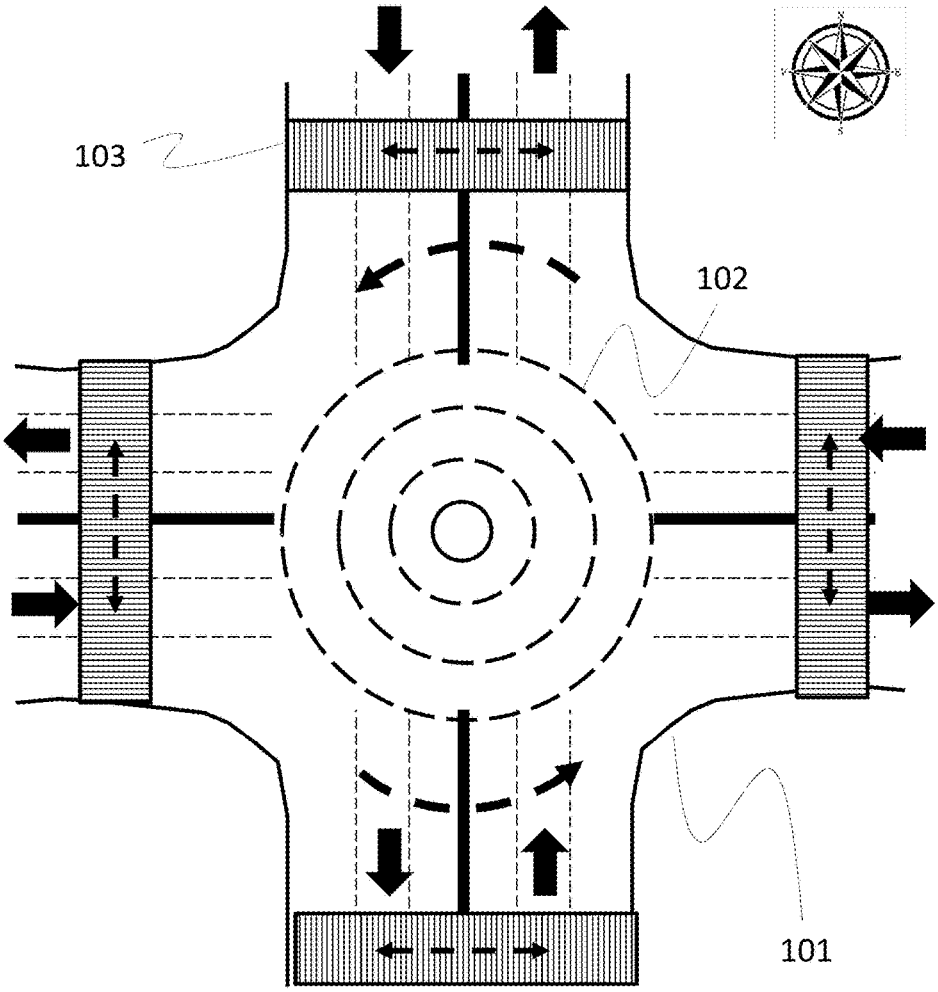
FIG. 1 depicts a four-exit traffic circle serving six lanes of traffic in perpendicular directions and four pedestrian cross walks.

FIG. 1 depicts an overhead view of a traffic-circle intersection, 101, with perpendicular six-lane roads and four pedestrian cross walks. In countries where vehicles travel on the right side of the road, the depicted traffic circle would divert vehicles to circular lane paths, 102, where the vehicles travel in a counter-clockwise direction as viewed from above. Such traffic circle intersections permit pedestrians to cross them by providing cross walks, 103, that are located back away from the circular lanes, 102. These cross walks allow pedestrians to walk across them in either direction, as shown by the dashed arrows. The dark, thick arrows show vehicular direction and the direction toward the upper edge of the page is denoted as northbound; to the right is eastbound; to the bottom is southbound and to the left is westbound. Note, a traffic circle may have as few as three streets leading into it, and may have more than four.

Figure 2:
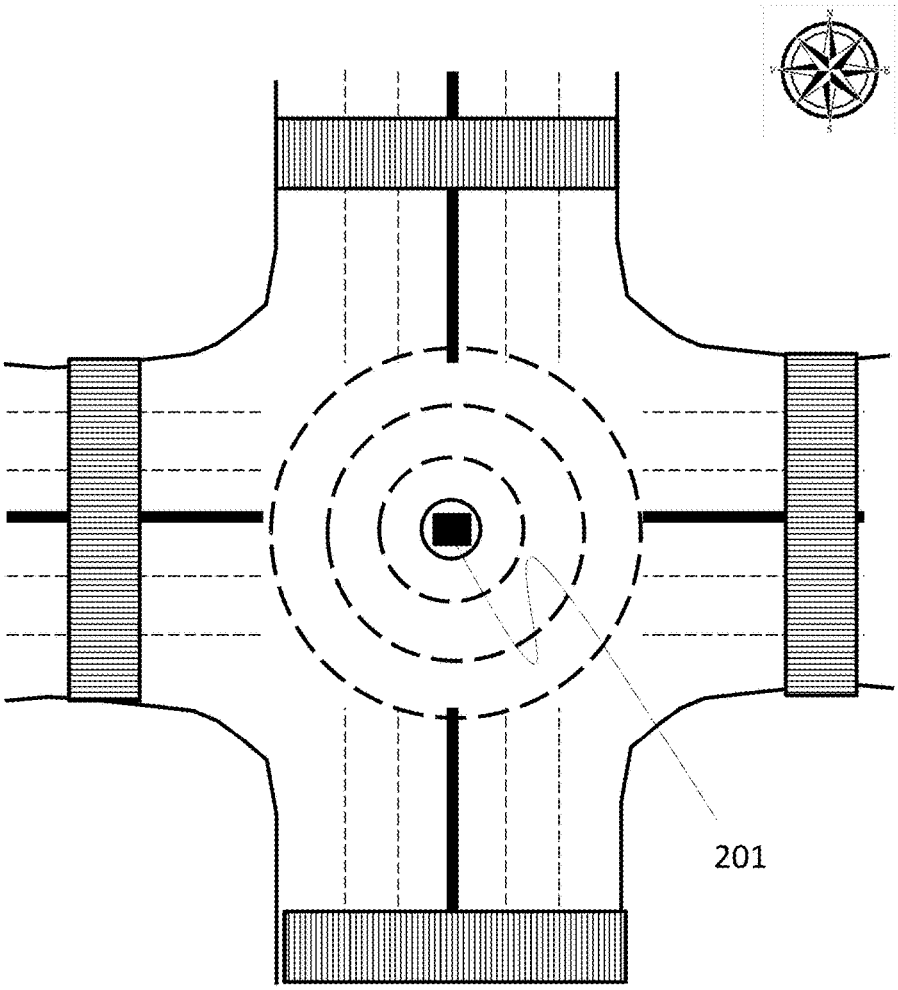
FIG. 2 depicts the invention system placement in the traffic circle of FIG. 1.

FIG. 2 depicts the invention system, 201, located essentially in the center of the traffic circle. The drawing is not drawn to scale and not shown are structures that divert vehicles entering the traffic circle into the circular lanes. The central location of the system allows it to sense position, direction and speed of pedestrians and vehicles in all pertinent directions.

Figure 3:
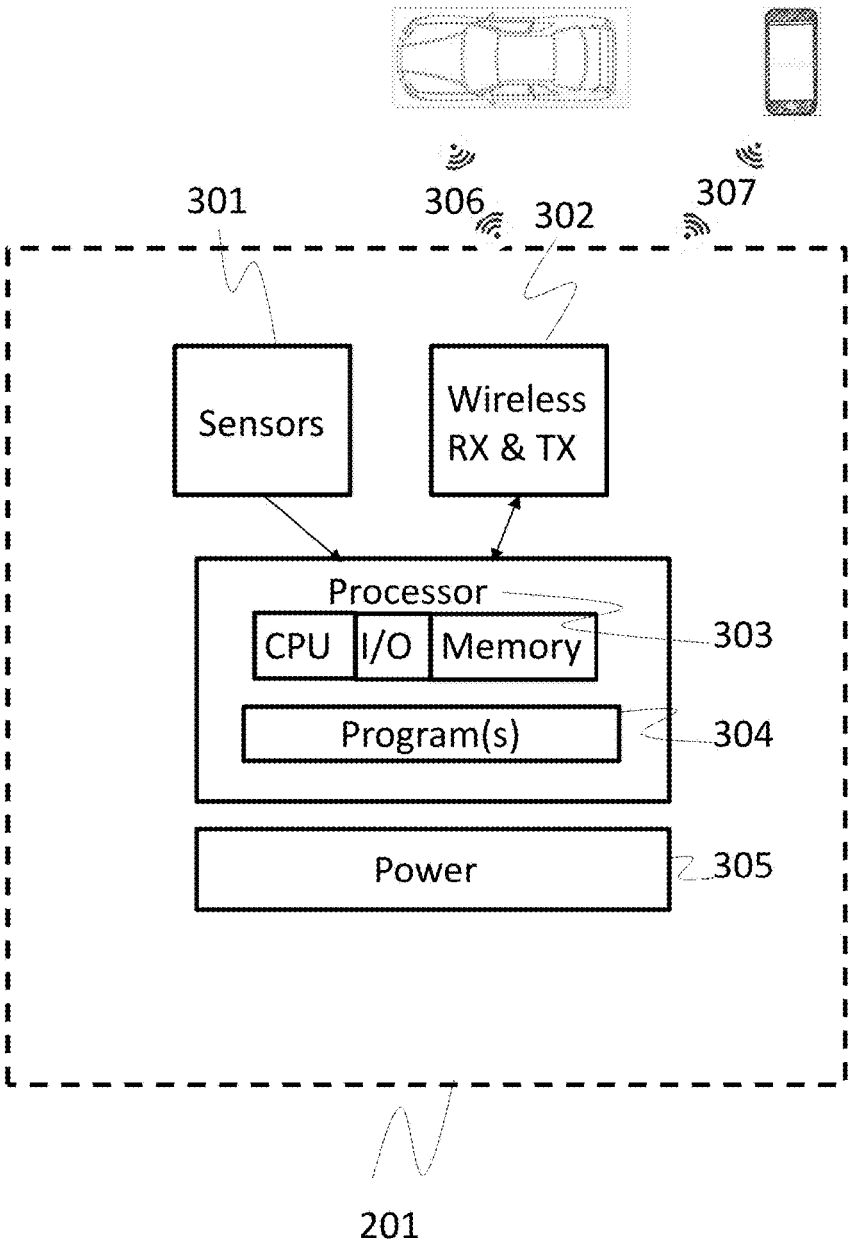
FIG. 3 shows one embodiment of the invention system.

FIG. 3 provides more detail about the invention system, 201. There is a sensor subsystem operative to sense position, direction and speed of pedestrians and vehicles and provide that data to a processing subsystem, 301. The term "sensor" comprises any variety of well-known technologies including but not limited to motion detection, position determination, and the like. It could include digital cameras, radar, infrared, sonar and any technology where successive sampling could determine position, direction and speed. A wireless receive/transmitter (RX & TX), 302, is operative to receive wireless signals from pedestrians' mobile devices, 306, and from vehicles, 307, and to transmit signals to the mobile devices of pedestrians and the wireless communications devices in vehicles. The processing subsystem, 303, executes a program or programs, 304, which maps the positions, directions and speeds of pedestrians and vehicles, in near real time, and determines the likelihood, L, of a collision. The invention system's response is determined by the measured L compared with a predetermined upper limit of L. A power subsystem, 305, provides power to the other subsystems. It may be sourced by utility power. In addition, it may also make use of renewable energy sources, such as solar or wind, with back-up batteries. It could also combine all of these power sources—utility, renewable and battery.

Figure 4:
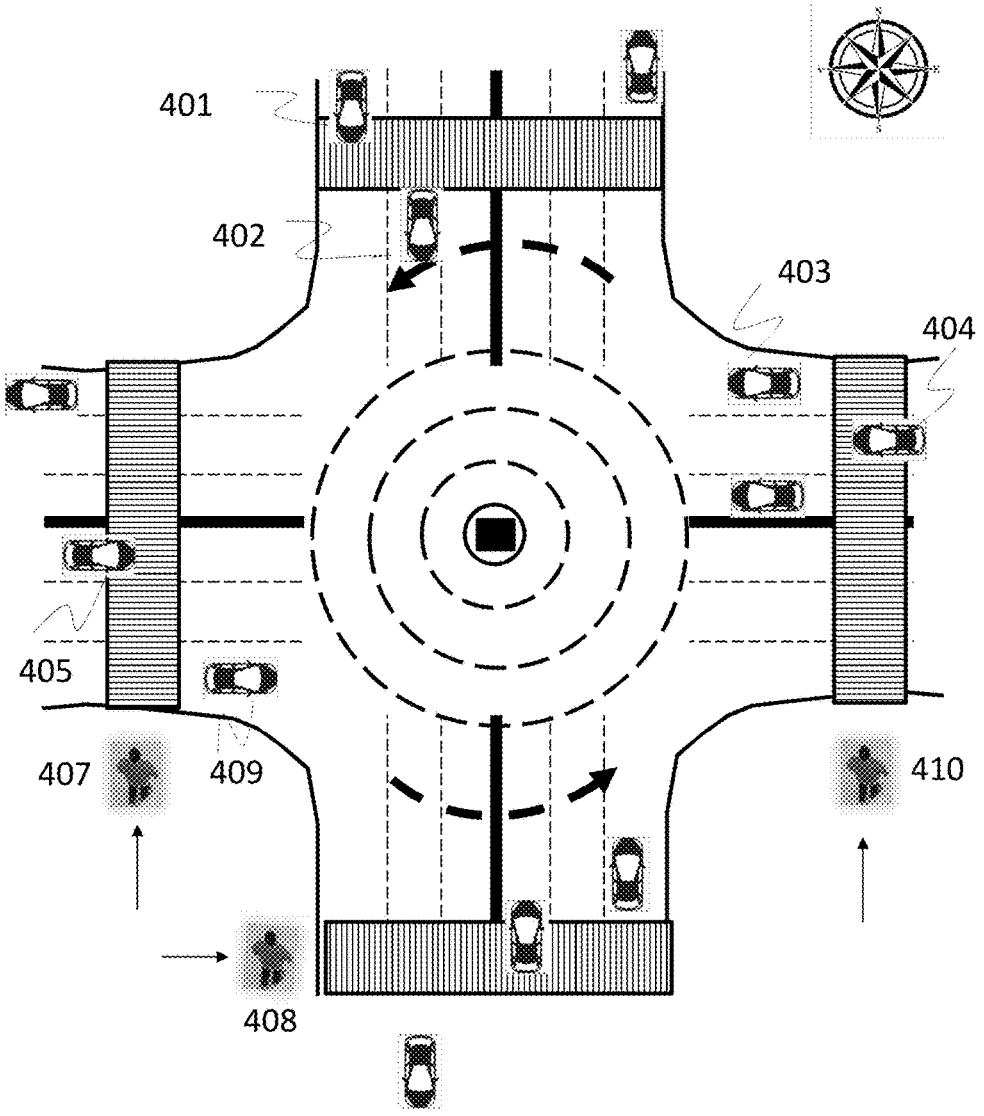
FIG. 4 depicts the traffic circle of FIG. 1 with vehicles and pedestrians entering and leaving the traffic-circle intersection.
Figure 5:
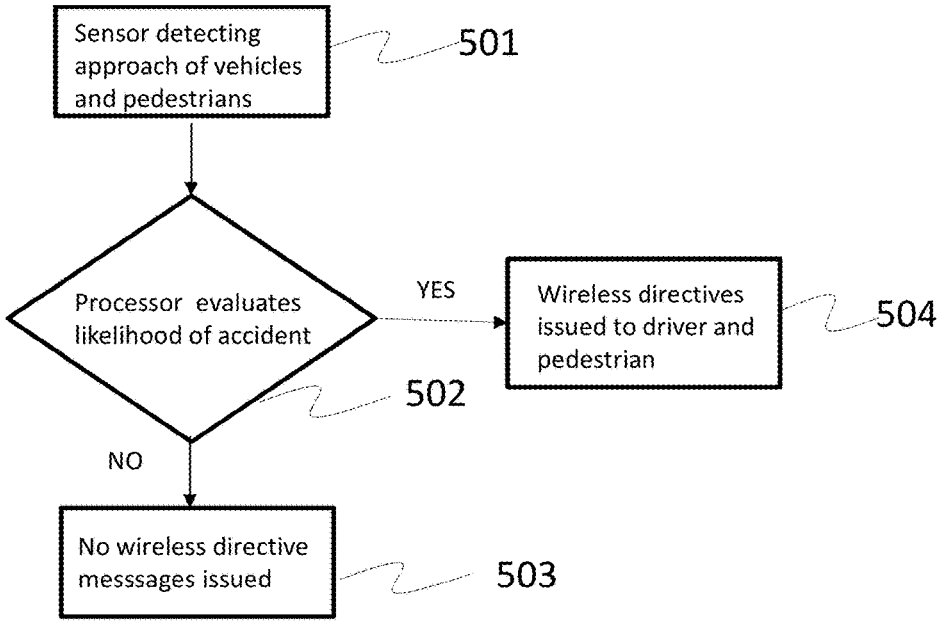
FIG. 5 depicts one embodiment of a pedestrian safety control flow.
Figure 6:
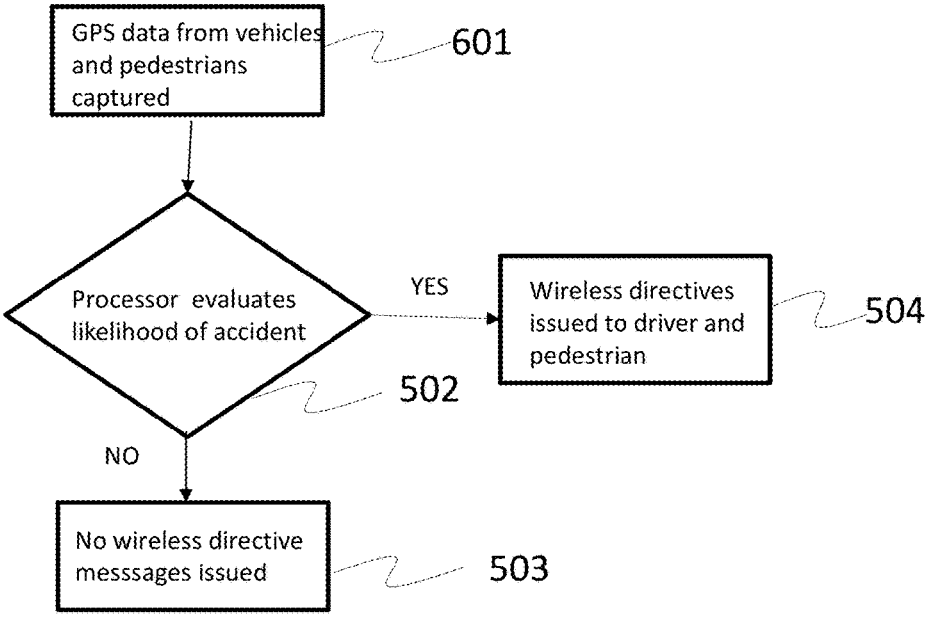
FIG. 6 depicts another embodiment of a pedestrian safety control flow
Figure 7:
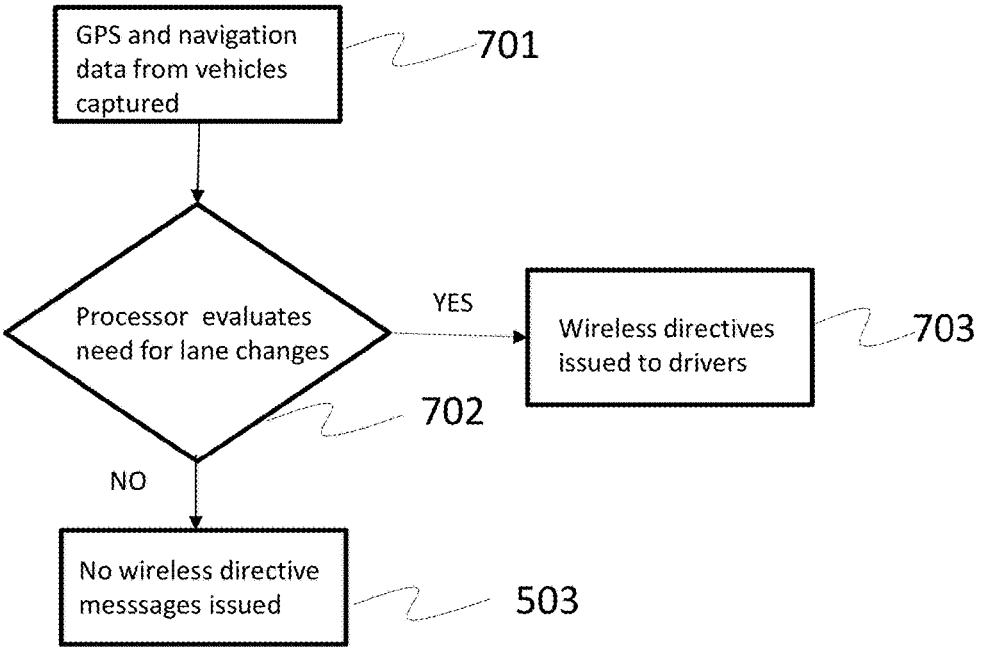
FIG. 7 depicts one embodiment of a vehicular safety control flow.

FIG. 4 depicts the traffic circle of FIG. 1 with vehicle approaching the traffic circle (401, 402, 403, 404, 405, 409) and pedestrians approaching the cross walks (407, 408, 410). It is the capture and processing of position, direction and speed information from the vehicles and pedestrians that determines processing outcomes and system actions. For example, pedestrian 408 walking in an eastbound direction on the southern crosswalk would likely receive no directive messages because the northbound vehicles will have traversed the cross walk long before the pedestrian gets to those positions, and the southbound vehicle has traversed the cross walk and is heading away from it. However, if vehicle 409 is determined to be given navigation directions to exit toward the south, then pedestrian 408 may be directed to stop and allow the vehicle 409 to proceed. Once 409 has done so, the system may send the pedestrian 408 an "okay to proceed" directive message. Pedestrian 407 is proceeding northward on a cross walk where again there are no apparent risks of safety issues. However, vehicle 401 may be given navigation directives to turn right and head westbound. Consequently, pedestrian 407 may receive a directive message to wait for vehicle 401 to proceed. Finally, pedestrian 410 heading northbound on a cross walk may receive no directives because the westbound vehicles will have traversed the cross walk and be heading away from it, and the two vehicles heading northbound have no navigation directives to turn right and head eastbound. Vehicle 404 may simply be heading westbound through the intersection. In that case the position in the middle lane is not an issue and no directive is received. However, if vehicle 404 is directed by its navigation system to go northbound (e.g. turn right at the first exit), the system will have directed the driver to change to the right lane before entering the traffic circle. Where southbound vehicles 401 and 402 enter the traffic circle, if both vehicles are simply continuing to head south, they would receive no directives and maintain their current lane positions. However, if 402 is directed by its navigation system to prepare to head westbound by turning right into the first exit, vehicle 402's driver would receive a lane change directive before entering the traffic circle, and vehicle 401 would receive an alert to slow down and allow vehicle 402 to change lanes. In all circumstances, if the system detects a pedestrian having entered a cross walk or traversing a cross walk, the system may direct a driver to halt allowing the pedestrian to complete the traverse. These are meant to be exemplary, only, and should not be read as limiting.

At a minimum, the invention system can rely upon sensor detection of position, direction and speed of pedestrians and vehicles. In the absence of wireless communications between system and vehicles/pedestrians, a visual display message can be used for directive messages. Ultimately, vehicles will be outfitted with standards-based navigation and inter-vehicle communications along with shared navigation data by vehicles in close proximity. The effectiveness of the invention system will increase as more vehicles and pedestrians have devices that provide ongoing GPS navigation and some standard wireless communications means for safety-oriented message dissemination.

It should be noted that the system as depicted in FIG. 3 is shown as separate subsystems within a dotted-line enclosure. The system could be implemented using separate subsystems and could be implemented with a greater degree of integration into a single system. The functions as depicted and disclosed are the key elements of the invention. How the functions are integrated is of no real consequence.

What is claimed is:

1. A system comprising:

a sensors subsystem operative to detect a position, direction and speed of moving pedestrians and vehicles;

a wireless communications subsystem operative to receive and transmit wireless signals;

a handheld device or devices comprising:

a GPS navigation subsystem operative to determine position of said handheld device, and a wireless communications subsystem operative to receive and transmit said wireless signals;

said GPS navigation subsystem, in a vehicle, operative to determine current location and provide incremental navigation directives predicated upon a specified destination;

a said wireless communications subsystem, in said vehicle, operative to receive and transmit said wireless signals;

a processing subsystem comprising:

a CPU subsystem;

an input/output subsystem; a program memory subsystem;

one or more programs for execution by said CPU subsystem;

a power subsystem operative to provide electrical power to said sensors, said wireless communications, and said processing subsystems.

2. A system as in claim 1 further comprising:

said power subsystem comprising:

utility power input.

3. A system as in claim 1 further comprising:

said power subsystem comprising:

solar panels; and batteries.

4. A system as in claim 1 further comprising:

said power subsystem comprising:

wind turbine; and batteries.

5. A system as in claim 1 further comprising:

said handheld device comprising:

said wireless communications subsystem operative to receive and transmit said wireless signals using short message service.

6. A system as in claim 1 further comprising:

said GPS navigation subsystem, in said vehicle, having an application program interface supporting integration with said wireless communications subsystem, in said vehicle, operative to receive and transmit said wireless signals.

7. A method of use comprising:

sensing positions, directions and speeds of pedestrians and vehicles approaching a traffic-circle intersection;

conveying said positions, directions and speeds data to a processing subsystem;

receiving shared near-term navigation directives from said vehicles;

computing a risk level, L, for a collision between said pedestrians and vehicles based on said positions, directions and speeds data conveyed to said processing subsystem and said near-term navigation directives;

computing said risk level, L, for a collision between said vehicles based on said positions, directions and speeds data conveyed to said processing subsystem and said near-term navigation directives;

comparing said computed risk level, L, to a predetermined upper limit, UL and;

if L is equal to or larger than UL, then responding with a directive message sent to appropriate drivers and said pedestrians; or if L is below UL, then taking no response action.

8. A method as in claim 7 further comprising:

receiving successive GPS navigation positions data from said pedestrians' handheld devices;

receiving said successive GPS navigation positions data from said vehicles' said GPS navigation systems;

determining said positions, directions and speeds based on said successive GPS navigation position data;

combining said positions, directions and speeds based on said successive GPS navigation position data with said positions, directions and speeds data conveyed by sensors subsystem.

9. A method as in claim 8 further comprising:

determining vehicle lane position prior to entering said traffic circle; receiving said shared near-term navigation directives from said vehicles; distilling near-term exit directives;

computing optimal vehicle lane position based on near-term exit directives;

determining said positions, directions and speeds of proximate vehicles;

combining said vehicle lane position, said shared near-term navigation directives, and said positions, directions and speeds of said proximate vehicles;

computing whether lane-change directives are needed;

computing whether said lane-change directives would pose safety issues for said proximate vehicles, and:

if said lane-change directives are warranted and no said safety issues with proximate vehicles would arise, then sending said lane-change directive messages to said appropriate drivers; or if said lane-change directives are warranted but it could cause said safety issues with proximate vehicles to arise, then sending directives to proximate vehicles to change speeds or lanes, first, and when said directives actions are confirmed by sensors or GPS data, sending said lane-change directives to said appropriate drivers.

* * * * *